US005312265A

United States Patent [19]

Fiori et al.

[11] Patent Number: 5,312,265

[45] Date of Patent: May 17, 1994

[54] ELECTRICAL CONNECTOR SUITABLE FOR USE WITH VARIABLE NUMBERS OF ELECTRICAL CONDUCTORS

[75] Inventors: Jean E. Fiori; Michael R. Strong, both of Midland, Mich.

[73] Assignee: Dow Corning Corporation, Midland, Mich.

[21] Appl. No.: 926,443

[22] Filed: Aug. 10, 1992

[51] Int. Cl.[5] ..... H01R 13/52

[52] U.S. Cl. ..... 439/271; 439/936; 439/426

[58] Field of Search ..... 439/199–201, 439/271–283, 936, 586, 587, 426

[56] References Cited

U.S. PATENT DOCUMENTS

| | | | |
|---|---|---|---|
| 3,972,581 | 8/1976 | Oldham | 439/426 |
| 3,989,338 | 11/1976 | Gosser | 339/96 |
| 4,085,993 | 4/1978 | Cairns | 439/201 |
| 4,696,540 | 9/1987 | Adams et al. | 439/201 |
| 4,795,354 | 1/1989 | Owen | 439/271 |
| 4,824,390 | 4/1989 | Crane et al. | 439/426 |

*Primary Examiner*—David Pirlot
*Attorney, Agent, or Firm*—Robert Spector

[57] ABSTRACT

This invention provides a single type of electrical connector suitable for use with cables containing from one up to the maximum number of electrical conductors that can be accommodated by passages within the connector without impairing the ability of the connector to exclude moisture and other contaminants from the area occupied by junctions between mating pairs of conductors. This is achieved by the combination of a preformed perforated gasket and a layer of penetrable, non-self-healing, non-flowing elastomer that seals all of the passages in the connector not occupied by conductors.

3 Claims, 1 Drawing Sheet

ELECTRICAL CONNECTOR SUITABLE FOR USE WITH VARIABLE NUMBERS OF ELECTRICAL CONDUCTORS

BACKGROUND OF THE INVENTION

Field of the Invention

This invention relates to electrical connectors. More particularly, this invention relates to a device for forming electrical connections between at least one pair of electrical conductors. The device contains one member of each conductor pair residing in individual passages. When the connector is joined with a mating connector the members of each pair of conductors are joined to complete the electrical circuit(s). The present connector provides a means for preventing entry of water vapor and other contaminants into the area occupied by the junctions between conductor pairs, irrespective of the number of conductor pairs being joined.

One method for sealing the area occupied by the junctions of conductor pairs in an electrical connector is by passing the conductors through a perforated gasket. The holes in the gasket are aligned with the passages of the connector shell containing the electrical conductors. The contour of the gasket conforms to the contour of the connector shell, and forms a seal when the mating sections of two connectors are joined.

To maximize production efficiency it is often desirable to fabricate a single connector for a variety of applications, some of which utilize fewer than the maximum number of conductors accommodated by the passages in the connector, thereby leaving some of the passages vacant.

It should be apparent that if any passages in the connectors do not contain conductors, the corresponding unoccupied holes in the gasket create the potential for gaps in the seal, allowing moisture and other contaminants to reach the area of the junctions between conductor pairs and adversely affect the mechanical and electrical properties of these junctions.

In the past, vacant passages in connectors containing perforated gaskets as sealing means have been filled with pins formed from an electrically insulating material. The contour of the pins corresponds to the contour of the passages. The disadvantage of this method is the cost of fabricating the insulating pins and inserting them in the unused passages of the connectors.

Penetrable, repairable gel type organosiloxane compositions have been used on the inner surface of electrical connectors in place of rubber gaskets to form seals around the electrical conductors. The cured gel is sufficiently flowable that it forms a seal around the conductor. A disadvantage of replacing a gasket with a cured gel in this application is the absence of sufficient cohesive strength and adhesion between the gel and the inner surface of the connector to avoid displacement of the gel, with accompanying loss of sealing action, in the presence of superatmospheric pressure applied through the unoccupied passages of the connector.

U.S. Pat. No. 3,989,338, which issued to Gosser on Nov. 2, 1976 describes a connector intended for the manual insertion of electrically conductive terminal pins in predetermined passages identified by numbers. The inventive feature of the connector is to increase the legibility of the numbers identifying the various passages by having the number appear on a layer of penetrable material that is adhered to the surface containing the holes.

The types of material from which the overlying layer can be formed and the nature of the adhesive are not described.

SUMMARY OF THE INVENTION

An objective of this invention is to provide a connector that forms a plurality of junctions between pairs of electrical conductors when joined with a mating connector. The connector contains a plurality of parallel passages and an elastomeric gasket at the mating surface of the connector. At least a portion of the passages are intended to be occupied by one member of each pair of conductors. When the connector is joined with a mating connector to complete the electrical circuits represented by the conductors, the gasket seals against at least one surface of the mating connector to prevent entry of contaminants into the area occupied by the junctions between pairs of conductors.

A second objective of this invention is to provide a single type of electrical connector that can be used with a variable number of conductors, from as few as one up to the maximum number capable of being accommodated by the connector. This flexibility is achieved with substantially no change in the ability of the connector to exclude moisture and other contaminants from the area occupied by junctions between conductor pairs that are formed when the connector is joined with a mating connector located on a cable or electrical device.

DETAILED DESCRIPTION OF THE INVENTION

This invention provides an electrical connector for a variable number of electrical conductors constituting a first set of conductors, where said connector comprises a housing having interior and exterior surfaces and is formed from an electrically insulating material; said housing comprises (1) an aperture for entry of a mating connector containing a second set of conductors intended to connect with corresponding members of said first set, and (2) an number of parallel conductor passages opposed to said aperture; a layer of penetrable, non-self healing, non-flowable material is adhered to a surface of said housing containing said passages and covers all of said passages; and where a gasket comprising a layer of cured elastomer is located adjacent to the interior surface of said housing opposing said aperture, contains an array of holes aligned with said passages and forms a seal against at least one surface of said mating connector.

Figure 2:
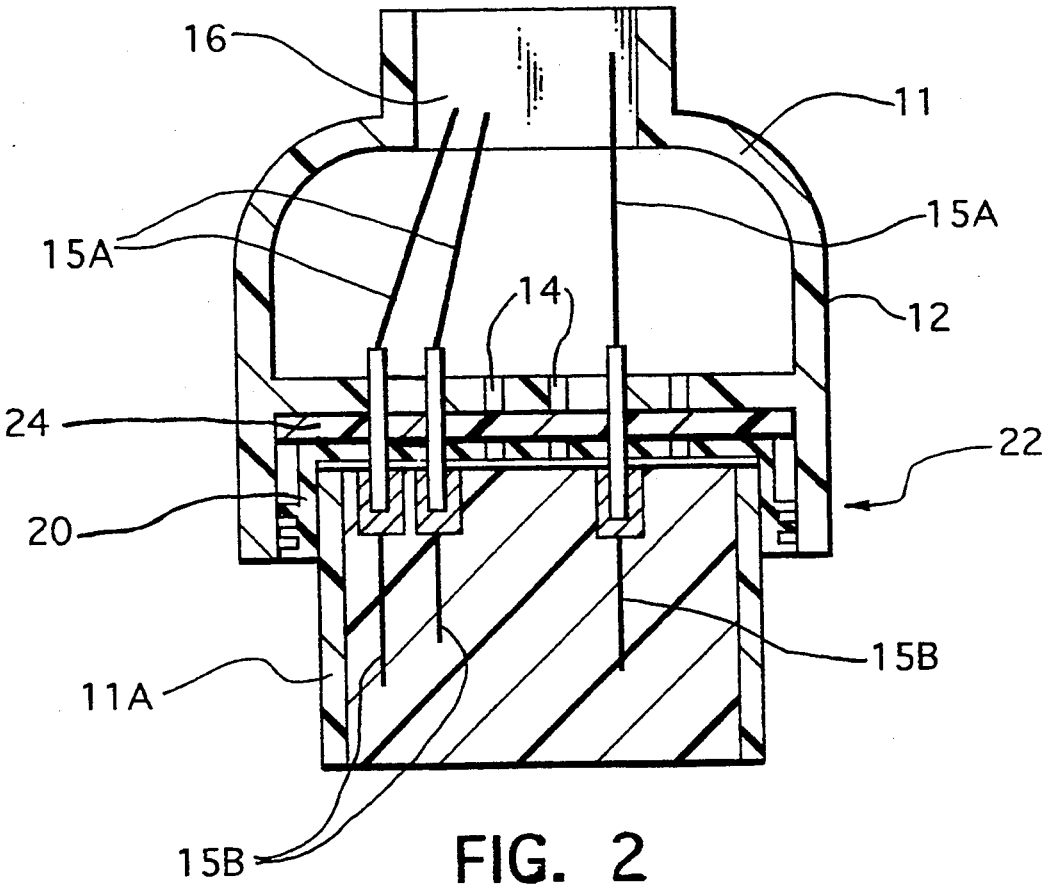
FIG. 2 is a cross-sectional view of the present connector containing a set of conductors that are joined with a mating set of conductors in a second connector. The present connectors comprise a housing (11) having exterior (12) and interior (13) surfaces. The housing is typically formed from an electrically non-conductive thermoplastic or thermosetting polymer such as natural and organic rubbers, resins, and polyorganosiloxanes.

One section of the housing contains a plurality of parallel passages (14) that serve as conduits for a set of electrical conductors (15 A in FIG. 2) that enter the housing through an orifice (16). The passages terminate at surfaces (17) and (18). Surface 17 faces an aperture

(19) intended to receive a mating connector housing (11A). The mating connector contains a second set of conductors (15B) that form electrical connections with each of the conductors contained in passages 14 when the mating connectors are united.

A gasket (20) formed from an elastomeric material is located adjacent to surface 17. The gasket comprises a substantially planar surface (21) extending over the area occupied by passages 14 and a ridge (22) encircling the perimeter of the gasket. Surface 20 contains an array of holes (23) aligned with passages 14. The ridge is intended to form a seal against the inner surface of the housing of the mating connector when the connector is inserted through aperture 19. A portion of housing 11A compresses ridge 22 of the gasket against a mating surface of housing 11, thereby forming an air tight seal around the perimeter of the junction of housings 11 and 11A.

The holes in the gasket are typically slightly smaller in diameter than the conductors, and are stretched during insertion of the conductors. The recovery properties of gasket enable it to form an air-tight seal around each of the conductors passing through the gasket.

Because the present connector is intended for use with as few as one conductor, not all of the passages 14 may be occupied by conductors.

A characterizing feature of the present connectors is the presence on surface 17 or 18 of a continuous layer of a penetrable, non-self-healing and non-flowable material (24) that is penetrated by each of the conductors occupying the housing. The function of this layer is to maintain a seal in all of the passages in which the layer has not been penetrated by insertion of a conductor into the passage. In the absence of this layer, if all of the passages 14 and the holes in gasket 20 corresponding to these passages are not occupied by conductors, moisture and other contaminants entering the housing in the area defined on one side by surface 18 could pass through the unoccupied passages 14 and corresponding holes in gasket 20 into the area occupied by the junctions of the conductor pairs and interfere with operation of the connector by adversely affecting the electrical and mechanical properties of the conductor junctions.

Figure 1:
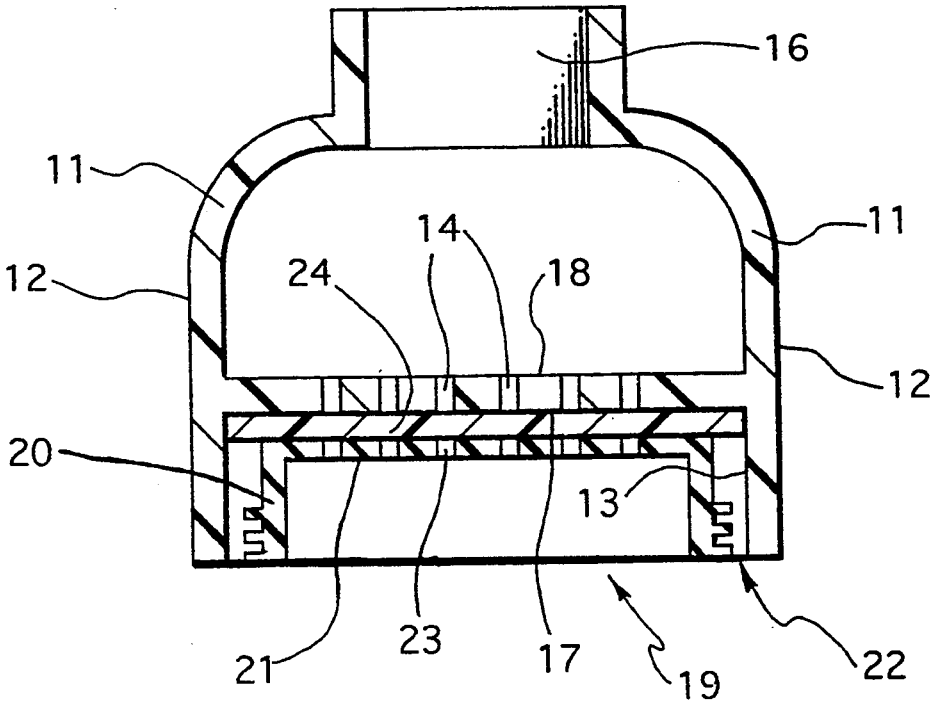
FIG. 1 is a cross-sectional view of an electrical connector of the present invention.

To ensure maintenance of an air tight seal under the conditions encountered by the connector during use, the layer of penetrable material 24 is adhered to the surface of the housing on which it resides. In the embodiment shown in FIG. 1 the elastomer layer is adhered to surface 17.

Layer 24 can be formed from any material which (1) is neither self-heals nor flows under its own weight or under the pressures encountered during use of the connector, and (2) can be penetrated by conductors during assembly of the present connector without tearing the material to the extent that the seals formed by the layer in adjacent passages are destroyed. The layer of material should also have sufficient strength to resist tearing or degradation under the conditions encountered during use of the connector, and sufficient flexibility to resist fracturing during insertion of the conductors. Useful materials include but are not limited to natural and synthetic organic polymers and polyorganosiloxanes.

Suitable materials for preparing the penetrable layer include but are not limited to elastomeric materials such as natural and synthetic rubbers, cellulosic materials, and resins that are sufficiently flexible to resisting cracking or fracturing during installation of the conductors to the extent that the seals on adjacent passages are destroyed.

Cured organosiloxane gels are not suitable for use as the penetrable layer because they typically do not retain adhesion when exposed to the pressures encountered during use of the connectors in automotive applications.

It will be understood that the electrical connectors intended for use as the mating portion of the present connectors may also have a layer of penetrable elastomer adhered to the surface containing the conductors intended to connect with the conductors occupying passages 14.

In preferred embodiments of the present connector the layer of penetrable material (24) is from 0.2 to 0.5 mm. in thickness and is prepared from a curable silica-filled organosiloxane composition that is curable by a platinum-catalyzed hydrosilylation reaction.

Typical physical properties for the penetrable material are a tensile strength of at least 3.5 MPa, an elongation within the range of from 90 to about 450% and a tear strength of from 2.6 to about 16 kN/m.

A preferred organosiloxane composition for use in preparing the penetrable layer comprises a liquid dimethylvinyl terminated polydimethylsiloxane, a resinous copolymer containing trimethylsiloxy, dimethylvinylsiloxy and $SiO_{4/2}$ units, an organohydrogensiloxane and a platinum-containing hydrosilation catalyst.

The penetrable layer is secured to the surface of the connector using an organic or silicone type of pressure sensitive adhesive. Preferred adhesives typically comprise a resinous organosiloxane copolymer, a polydiorganosiloxane gum and a suitable solvent and are described in U.S. Pat. No. 5,100,976.

In a typical assembly operation the layer of penetrable material (24) is secured in position on the interior or exterior surface of the shell using any suitable adhesive, following which the conductors are forced through the layer and into their respective passages. The diameter of the conductors is usually substantially equal to the diameter of the passages, thereby enabling the passages to secure the conductors in the desired position once they have been inserted into the passages.

The gasket (20) is preferably a penetration resistant elastomeric material to avoid being accidentally punctured by the terminal pins during assembly of the connector. Preferred embodiments of the gasket are prepared from silica-reinforced liquid or high consistency organosiloxane composition that cures by a platinum-catalyzed hydrosilylation reaction. Typical properties of cured elastomers suitable for use as gaskets for the present connectors are:

Tensile Strength—3 to 6 Mpa
Elongation—200 to 450 percent
Tear Strength—10 to 14 kilonewtons per meter
Compression Set—50 to 60 percent, measured after 22 hours at 77° C.

We claim:

1. An electrical connector accommodating a variable number of electrical conductors constituting a first set of conductors, where said connector comprises a housing having interior and exterior surfaces and formed from an electrically insulating material, said housing comprising (1) an aperture for entry of a mating connector containing a second set of conductors intended to connect with corresponding members of said first set, and (2) a number of parallel conductor passages for said first set of conductors, said passages being opposed with respect to said aperture, a layer of a penetrable, non-self-healing material adhered to the surface of said housing containing said passages and covering all of said passages, and a gasket comprising a layer of cured elastomer located adjacent to the interior surface of said housing opposing said aperture, where said gasket contains an array of holes aligned with said passages and forms a seal against at least one surface of said mating connector, and where said layer is continuous and uninterrupted prior to entry of said first set of conductors into said passages.

2. A connector according to claim 1 where the body of said connector is formed from a thermoplastic or thermosetting organic or organosiloxane polymer composition, said penetrable material is formed from a silica-filled organosiloxane composition and is adhered to the interior surface of said housing, a portion of said passages are occupied by said first set of conductors and said gasket is formed from a curable organosiloxane or organic polymer composition.

3. A connector according to claim 2 where said penetrable layer is adhered to said surface using a pressure sensitive adhesive and said organosiloxane composition is cured using a platinum catalyzed hydrosilation reaction.

* * * * *